US005316395A

United States Patent [19]

Imai

[11] Patent Number: 5,316,395

[45] Date of Patent: May 31, 1994

[54] PRINTING APPARATUS HAVING HEAD GAP ADJUSTING DEVICE.

[75] Inventor: Masayuki Imai, Yokohama, Japan

[73] Assignee: Fujitsu Limited, Kawasaki, Japan

[21] Appl. No.: 690,831

[22] Filed: Apr. 24, 1991

[30] Foreign Application Priority Data

Apr. 25, 1990 [JP] Japan ..... 2-109588
Jul. 5, 1990 [JP] Japan ..... 2-71113

[51] Int. Cl.[5] ..... B41J 11/20
[52] U.S. Cl. ..... 400/56; 400/58,711
[58] Field of Search ..... 400/55, 56, 57, 58, 400/59, 708, 711

[56] References Cited

U.S. PATENT DOCUMENTS 4,589,784 5/1986 Valle et al. ..... 400/56
4,780,007 10/1988 Weeks et al. ..... 400/58

FOREIGN PATENT DOCUMENTS 152976 9/1982 Japan ..... 400/58
7369 1/1983 Japan ..... 400/56
60-56202 4/1985 Japan .
101058 6/1985 Japan ..... 400/56
78770 4/1988 Japan ..... 400/58
2-1356 1/1990 Japan .

*Primary Examiner*—Edgar S. Burr
*Assistant Examiner*—Stephen R. Funk
*Attorney, Agent, or Firm*—Staas & Halsey

[57] ABSTRACT

A printing apparatus includes a printing head for printing on a bank book, a platen disposed opposite the printing head, and a cam mechanism for moving the platen. A sensor detects the thickness of the bank book which is between the printing head and the platen, and a sensor moving mechanism moves the sensor toward or away from the platen. A controller controls the operation of the cam mechanism and the sensor moving mechanism as the sensor is moved to a measuring position approaching the printing head. The platen is moved toward the printing head according to a detected value, and then the sensor is retracted from the measuring position. As a result, after moving the platen, the sensor does not contact the surface of the bank book, and therefore does not produce jamming or oblique feeding of the bank book during a line feed or printing operation.

13 Claims, 10 Drawing Sheets

MOTOR
DRIVE CIRCUIT
PM
DRIVE UNIT
M P U
SENSOR SIGNAL PROCESSING CIRCUIT
FROM LIGHT SENSING DEVICE 174
FROM PHOTOSENSOR 134a
FROM PHOTOSENSOR 134b (a) BANK BOOK FEEDING MOTOR
+
0
−
T1
T2
T7
(b) PLUNGER MAGNET
MAGNETIZATION
DEMAGNETIZATION
(c) LIGHT SENSING DEVICE
ON
OFF
T3
T5
(d) PULSE MOTOR
+
0
−
T4
T6
PRINTING OPERATION
T10
T8
T9

PRINTING APPARATUS HAVING HEAD GAP ADJUSTING DEVICE.

BACKGROUND OF THE INVENTION

1. Field of the Invention

This invention relates to a printing apparatus for printing on recording media of varying thickness. More particularly, this invention relates to a printing apparatus in which a predetermined gap between a printing head and a platen can be easily set in accordance with the thickness of a recording medium to be used.

2. Description of the Related Art

A printing apparatus is required to optimally set a distance which is called a print gap, between an end part of a printing head and a surface of a printing medium, in order to obtain high quality printing on the recording medium. It is therefore desirable to preset the print gap in accordance with the thickness of the recording medium, such as a bank book, single layer paper, multi-carbon paper, or the like.

FIG. 14 is a front elevation view of a prior art printing apparatus. In FIG. 14, the printing apparatus includes a printing head 12, a platen 14, and a pressure sensor 16. The printing head 12 is positioned adjacent the platen 14, with an ink ribbon 18 and a head mask 20 having a print window 22 positioned therebetween. The printing head 12, ink ribbon 18 and head mask 20 are transferred along the platen 14 by a carriage (not shown in FIG. 14) to print out data on a recording medium 10.

The platen 14 includes cams 24*a* and 24*b*, cam followers 26*a* and 26*b*, a shaft 28, and springs 30*a* and 30*b*. The cam followers 26*a* and 26*b* are individually fixed to each side portion of the platen 14. The cams 24*a* and 24*b* respectively engage the cam followers 26*a* and 26*b*, and the cams 24*a* and 24*b* are connected to each other by the shaft 28. The springs 30*a* and 30*b* energize the platen 14 so the cam followers 26*a* and 26*b* are always in contact with the cams 24*a* and 24*b*, respectively. The shaft 28 is connected to a pulse motor 32. The pulse motor 32 and the pressure sensor 16 are coupled to a controller 34.

In FIG. 14, the printing medium 10 is fed to the printing area formed between the printing head 12 and the platen 14 by feed rollers (not shown in FIG. 14). Before the recording medium 10 reaches the platen 14, the platen 14 has been previously located at a lowered position. Therefore, the recording medium 10 is smoothly fed on the platen 14. After the recording medium 10 has reached the position of the platen 14, the pulse motor 32 is driven to rotate the cams 24*a* and 24*b* under control of the controller 34. As a result, the platen 14 is pushed upwardly by the cam followers 26*a* and 26*b*, and the recording medium 10 is positioned at the front surface of the head mask 20.

When the output signal of the pressure sensor 16 reaches a predetermined pressure value, the pulse motor 32 is driven in the reverse direction by a predetermined number of steps, so that the platen 14 is lowered. A proper gap is thereby set between the front surface of the head mask 20 and the surface of the recording medium 10, because the distance from the front surface of the head mask 20 to the end part of the printing head 18 is always kept at a predetermined value.

FIG. 15 is a side elevation view of another prior art printing apparatus. In FIG. 15, a printing head 40 is positioned against a platen 42 with an ink ribbon 44, a head mask 46 having a print window (not shown in FIG. 14), and a recording medium 48 therebetween.

The platen 42 is supported by levers 50*a* and 50*b* and is upwardly energized by a spring 52 to push the recording medium 48 against the head mask 46. The movement of the platen 42 is regulated by a stopper 54. The print gap between the surface of the recording medium 48 and the end part of the printing head 40 is set because a gap from the front surface of the head mask 46 to the end part of the printing head 40, is set.

In FIG. 15, when a recording medium 48 has been fed to a printing area between the printing head 40 and the platen 42 by a feed roller (not shown in FIG. 15), the platen 42 is pushed downwardly by the force of the recording medium 48 which is fed by the feed roller, against the elastic force of the spring 52. The recording medium 48 is set to a printing position between the printing head 48 and the platen 42.

In the prior art apparatus of FIG. 14, because the pressure sensor 16 protrudes from the front surface of the head mask 20, the pressure sensor 16 tends to hook or snag the recording medium 10 during the printing operation, so that the recording medium 10 is shifted to an improper position. Also, because the pressure sensor 16 contacts the recording medium 10 during line feed operation, the recording medium 1 0 tends to be fed in an oblique direction, making it impossible to print out at the proper position on the recording medium 10. Moreover, since a surface of the pressure sensor 16 slides on the recording medium 1 0 during the printing and line feed operation, the surface of the pressure sensor 16 becomes worn, and the gap between the surface of the recording medium 1 0 and the head mask 20 is changed. Therefore, it is also impossible to maintain the desired gap for a long period of time.

On the other hand, in the prior art apparatus of FIG. 15, due to friction between the recording medium 48 and the head mask 46, the recording medium 48 can become jammed. In addition, where a pulse motor is used as a driving source for spacing of the printing head 40, synchronous operation of the pulse motor is disturbed by the friction, and asynchronous operation is generated. The asynchronous operation results in a problem that a printing position of a character to be printed out on a recording medium 48 is shifted to an improper position.

SUMMARY OF THE INVENTION

Accordingly, it is an object of the present invention to provide an improved printing apparatus which is not subject to the defective printing of prior art apparatus.

Another object of the present invention is to provide a printing apparatus wherein a surface of a pressure sensor does not become worn.

Additional objects and advantages of the present invention will be set forth in the description which follows, and, in part, will be clear from the description, or may be learned by practice of the invention. The objects and advantages of the invention may be realized and obtained by means of the instrumentalities and combination particularly pointed out in the appended claims.

To achieve the foregoing objects and in accordance with the purpose of the invention as embodied and broadly described herein, there is provided a printing apparatus comprising: a printing head which prints on a recording medium; a platen having a surface disposed opposite said printing head; first shift means for relatively moving said printing head and said platen toward or away from each other to form a predetermined gap between said printing head and a surface of the recording medium; detecting means for detecting a thickness of the recording medium, and for producing an output signal, said detecting means having a contact portion which contacts the surface of the recording medium positioned between said printing head and said platen; second shift means for moving the contact portion of the detecting means towards and away from the surface of the platen; and control means, operatively connected to said detecting means for controlling the second shift means to move the contact portion of the detecting means away from the surface of the recording medium after it is determined that the predetermined gap between the printing head and the surface of the recording medium has been formed in accordance with the output signal from said detecting means.

BRIEF DESCRIPTION OF THE DRAWINGS

The accompanying drawings, which are incorporated in and constitute a part of the specification, illustrate embodiments of the invention and, together with the description, serve to explain the principles of the invention. In the drawings, like numerals refer to like parts throughout.

FIGS. 11A and 11B are schematic views of another embodiment of a printing apparatus in accordance with the present invention, wherein FIG. 11A illustrates how a pressure sensor approaches a recording medium on a platen, and wherein FIG. 11B illustrates how a pressure sensor is retracted from a recording medium on a platen;

DETAILED DESCRIPTION OF THE PREFERRED EMBODIMENTS

Reference will now be made in detail to the present preferred embodiment of the invention, examples of which are illustrated in the accompanying drawings.

Figure 1:
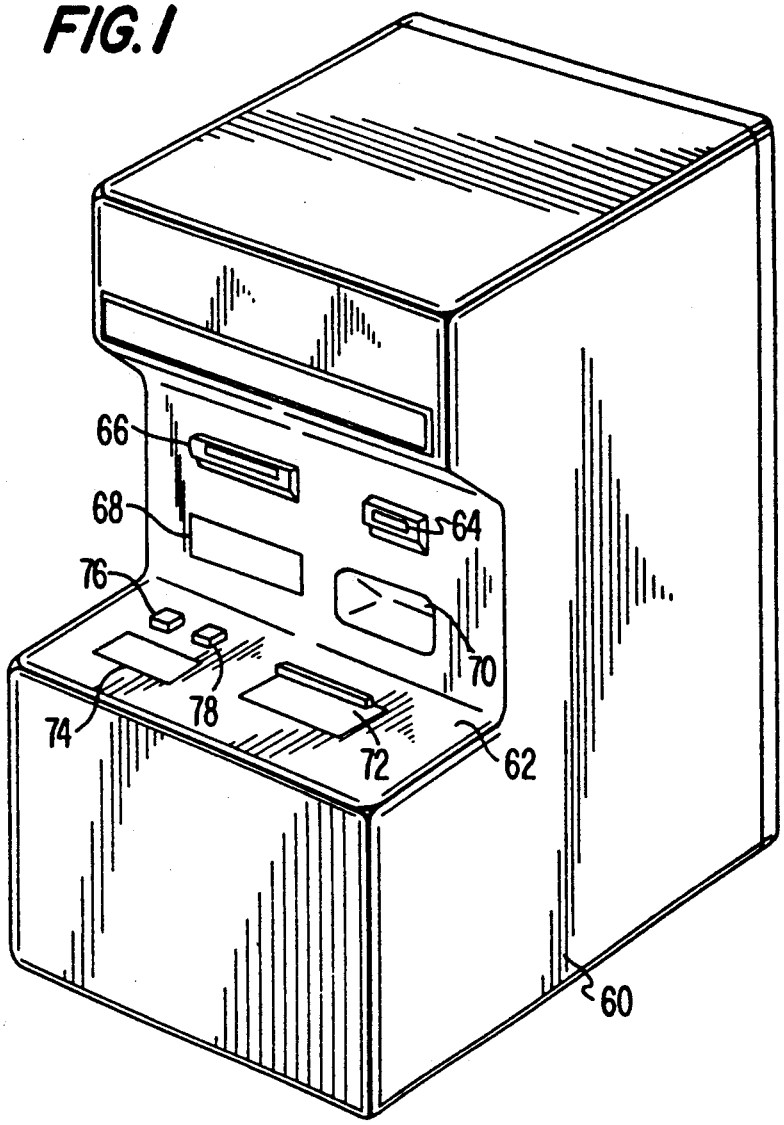
FIG. 1 is a perspective view of an automatic teller machine having a printing apparatus using the present invention.

FIG. 1 is a perspective view of an automatic teller machine having a printing apparatus in accordance with the present invention. In FIG. 1, the automatic teller machine (ATM) includes an L-shaped cabinet 60 having an operating portion 62 on the front surface thereof. It is used by a customer to deposit or withdraw money. A card inserting slot 64 is used to insert an identification (ID) card. A bank book inserting slot 66 is used to insert a bank book on which is recorded an account number, balance amount, etc. A guiding display 68 instructs the customer how to operate the ATM to deposit or withdraw money. A bill discharging slot 70 is used to discharge paper currency in response to a withdrawal request.

A currency inserting slot 72 is used to deposit paper or coin currency. A display 74 is used to display an amount which is input by a keyboard (not shown) for withdrawal from an account, or the amount which is deposited to the account from the currency inserting slot 72. The customer actuates an approval key 76 when an instruction on the display 74 is correct, and a cancel key 78 when the display 74 is wrong.

Figure 2:
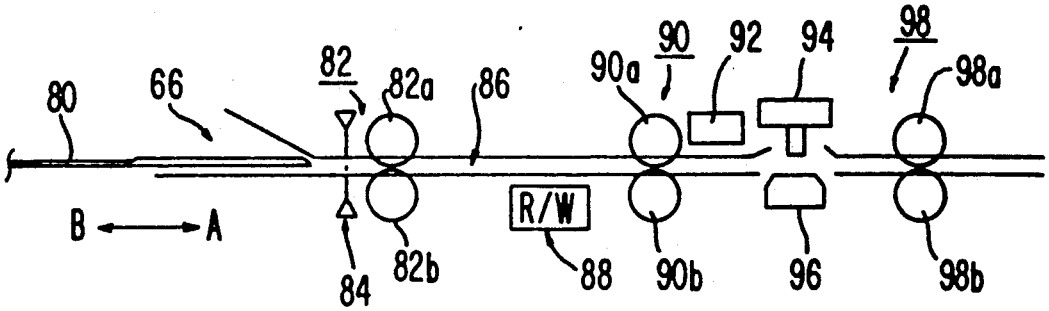
FIG. 2 is a schematic view of a printing unit of the automatic teller machine of FIG. 1.

FIG. 2 is a schematic view of a printing unit of the ATM as shown in FIG. 1. In FIG. 2, a bank book feeding path 86 is located along the horizontal line in the ATM to be easily inserted into or withdrawn from the printing unit for maintenance by using a slide rail (not shown). The bank book 80 is inserted through a bank book inserting slot 66 and is fed in a direction of an arrow A by feed rollers **82*a* and 82*b* when the insertion of the bank book 80 is detected by a sensor 84. Then the bank book 80 is fed along a feeding path 86 to a reading/writing portion in which a reading/writing head 88 is provided. The bank book 80 has a magnetic stripe (MS) on which is recorded data such as an account number or a balance amount. The data is read from the MS by the reading/writing head 88 while the bank book 80 is fed by the feed rollers 82*a*, 82*b* and by feed rollers 90*a*, 90*b*. Next, position data for a print line to be printed out and page mark data on the bank book 80, is read out by a reading sensor 92 while the bank book 80 is being fed by the feed rollers 82 and 90. Then a printing line to be printed on in the bank book 80 is set to a printing position formed between a printing head 94 and a platen 96 by the feed rollers 90 and feed rollers 98*a*, 98*b* in accordance with the page mark data and the position data read by the reading sensor 92**.

When a customer inputs transaction data via a keyboard (not illustrated in FIGS. 1 and 2) to deposit or withdraw money, the data is sent from the ATM to a host computer (also not illustrated), with the customer data read by the reading/writing head 88. After this data is processed by the host computer, the processing data, which is posting data, including a balance amount, is sent to the ATM. The data is then printed out on the bank book 80 by the printing head 94. The bank book 80 is then fed in a direction of an arrow B by the feed rollers 82, 90 and 98. While the bank book 80 is being fed past the reading/writing head 88, the transaction data is also recorded on the MS of the bank book 80. The bank book 80 is finally ejected from the bank book inserting slot 66 by the feed rollers 82. At the same time, when the customer has input data to withdraw money, paper currency is also discharged from the bill discharging slot 70.

As explained above, posting is carried out to the bank book 80 by using the printing head 94. In this case, the thickness of the bank book 80 varies in accordance with the number of pages which have been printed previously. Therefore, to maintain a normal printing operation, a gap between the printing head 94 and the platen 96 must be adjusted to be a predetermined gap in accordance with the thickness of the bank book 80.

Figure 3:
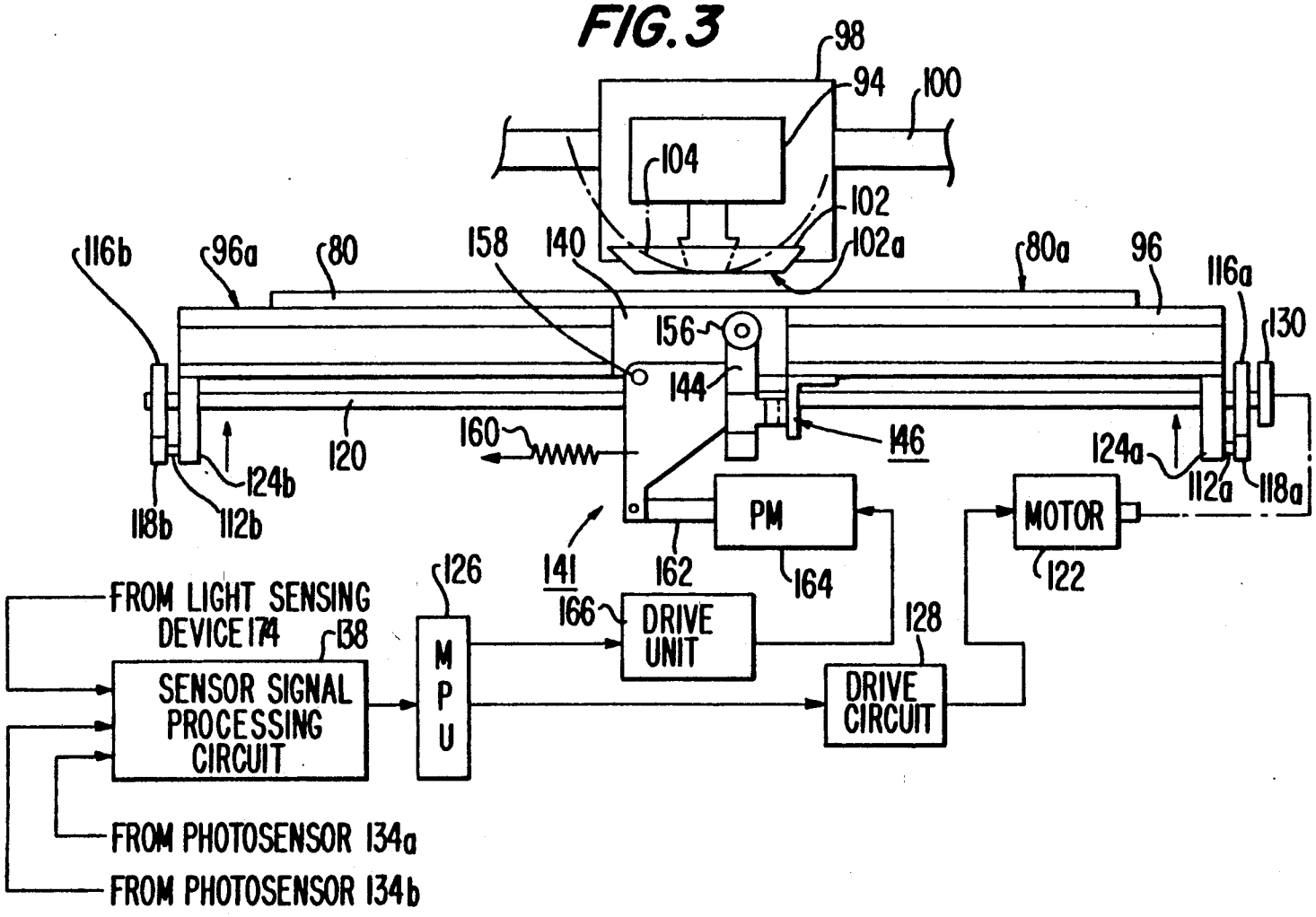
FIG. 3 is a front elevation view and a schematic block diagram illustrating a printing apparatus in accordance with an embodiment of the present invention, wherein a gap between a printing head and a platen is adjustable.
Figure 4:
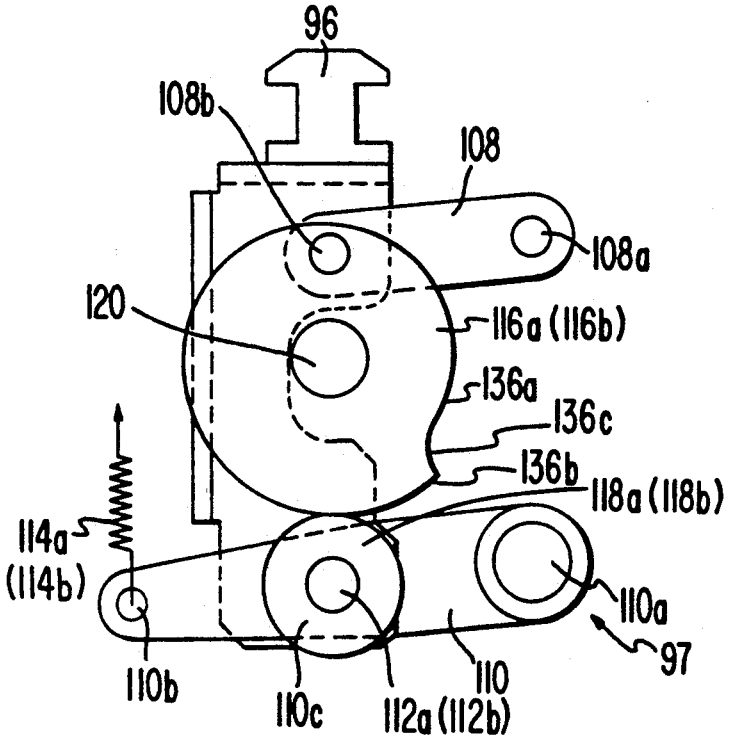
FIG. 4 is a side elevation view of the printing apparatus shown in FIG. 3.
Figure 6:
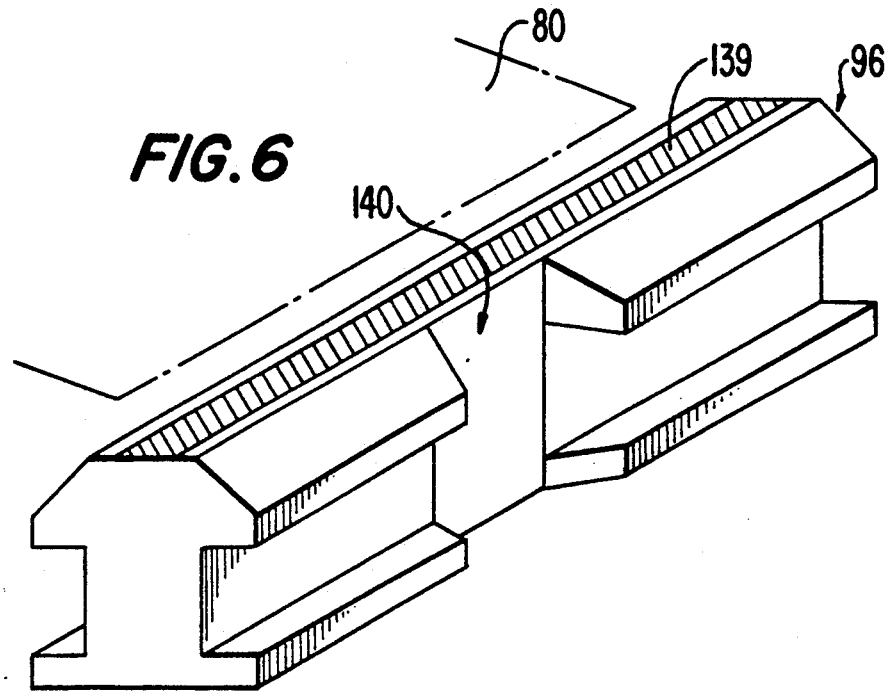
FIG. 6 is a perspective view of the platen shown in FIG. 3 and FIG. 4.
Figure 5A:
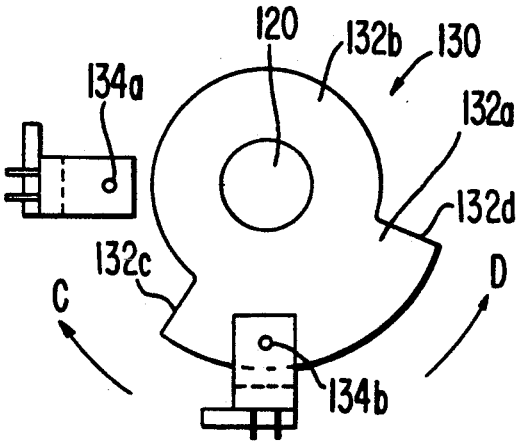
FIG. 5A is a side view of a phase detecting plate coupled to a cam as shown in FIG. 3.
Figure 5B:
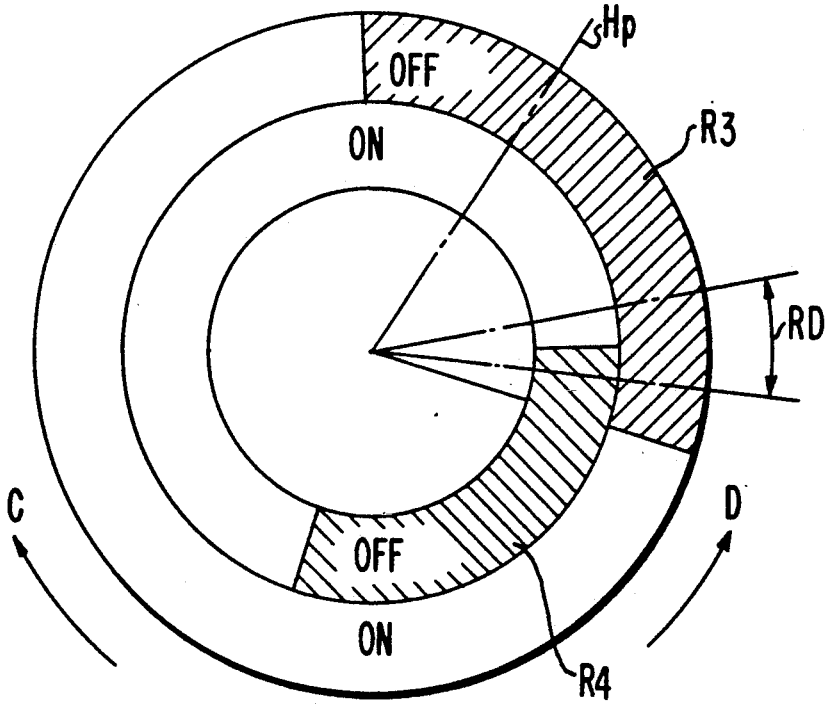
FIG. 5B is a schematic diagram for explaining the operation of the phase detecting plate shown in FIG. 5A.
Figure 7:
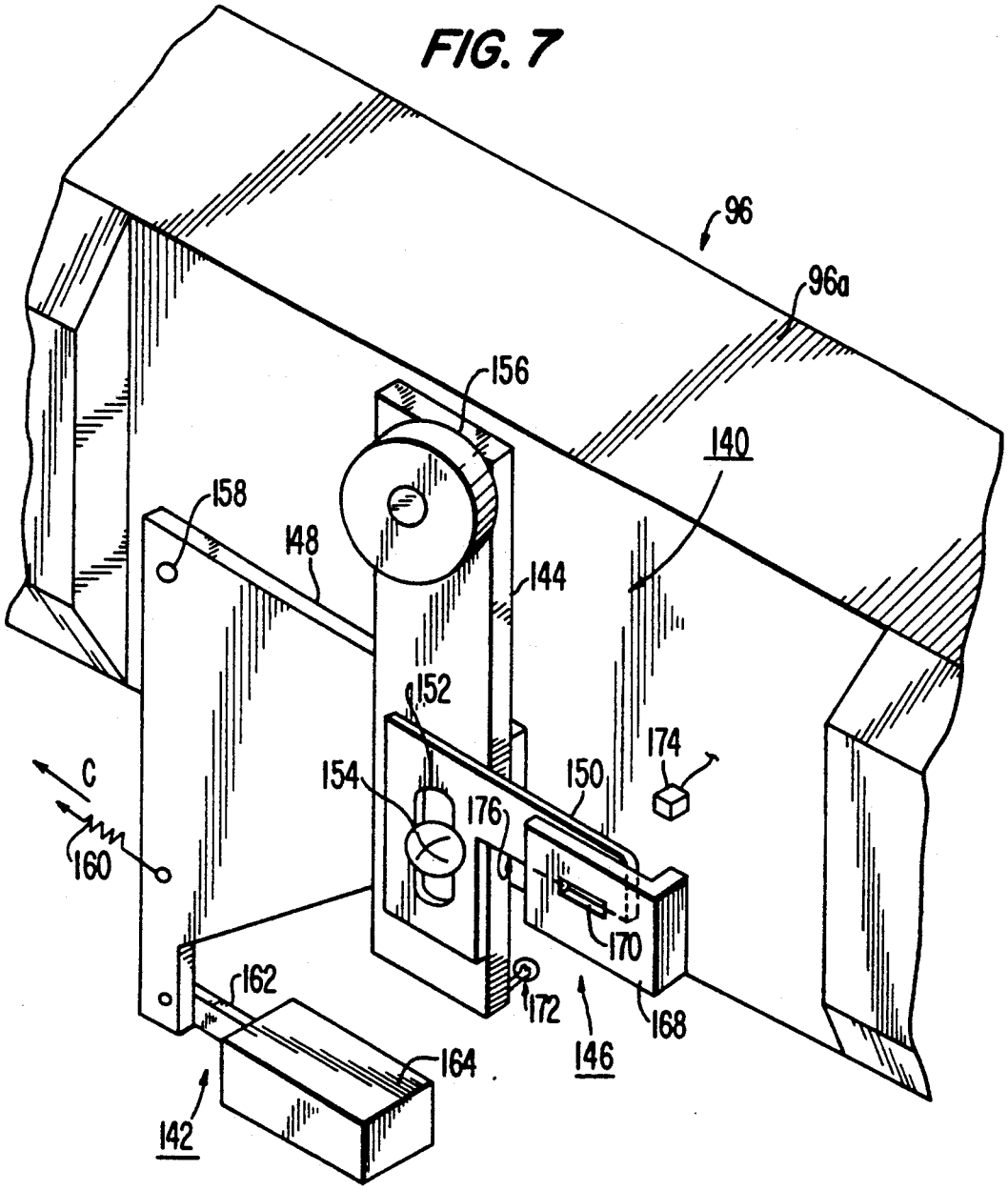
FIG. 7 is a perspective view of an enlarged portion of the printing apparatus shown in FIG. 3.

FIG. 3 is a front elevation view and a schematic block diagram illustrating a printing apparatus in accordance with an embodiment of the present invention, in which a gap between a printing head and a platen is adjustable. FIG. 4 is a side elevation view of the printing apparatus shown in FIG. 3. FIG. 5A is a diagram of the structure of the cam phase detection plate shown in FIG. 3. FIG. 5B is a diagram for explaining the operation of the phase detection plate shown in FIG. 5A. FIG. 6 is a perspective view of the platen shown in FIG. 3 and FIG. 4, and FIG. 7 is a perspective view of an enlarged portion of the printing apparatus shown in FIG. 3.

Referring to FIGS. 3–7, the printing head 94 is placed on a carriage 98 which travels on a guide shaft 100 and is transferred along the platen 96 by a driving motor (not shown) and a drive belt (not shown). The printing head 94 is a dot matrix type printing head, such as a wire dot printing head or a thermal printing head. A head mask 102 and an ink ribbon 104 are also placed on the carriage 98, and are transferred with the printing head 94. The head mask 102 has a surface **102*a* and a print window (not shown) at a portion where the end portion of the printing head 94 faces the platen 96**.

The platen 96 is supported by a support mechanism 97 including levers 108 and 110 as shown in FIG. 4. End portions **108*a* and 110*a* of the levers 108 and 110 are rotatably connected to a frame (not shown) of the printing unit. An end portion 108*b* of the lever 108 is rotatably connected to the platen 96, and a center portion 110*c* of the lever 110 is rotatably connected with a shaft 112*a* protruding from the platen 96. One end of a spring 114*a* is hooked on an end portion 110*b* of the lever 110 to bias the platen 96 toward the printing head 94. The other end of the spring 114*a* is fixed to the frame of the printing unit (not shown). In addition, an identical platen support mechanism 97 is also provided on the other end of the platen 96**.

The platen 96 is moved by a cam mechanism to cause the bank book 80 to contact the surface **102*a* of the head mask 102 and to move the bank book 80 away from the surface of the head mask 102. The cam mechanism includes cams 116*a*, 116*b*, cam followers 118*a*, 118*b*, a shaft 120, and a pulse motor 122. The cams 116*a*, 116*b* are connected to each other by the shaft 120 which is rotatably fixed to flange portions 124*a*, 124*b* of the platen 96. The cam followers 118*a*, 118*b* are fixed to the platen 96 through the shafts 112*a*, 112*b*. The pulse motor 122 is connected to the shaft 120, and is capable of rotating the cams 116*a*, 116*b* under control of a microprocessor unit (MPU) 126 through a driving circuit 128**.

To detect the position of the cams **116*a*, 116*b*, where the cams 116*a*, 116*b* are secured to the shaft 120 as shown in FIG. 4, a phase detecting plate 130 is secured to the shaft 120, as shown in FIG. 5A. The phase detecting plate 130 has a longer radius portion 132*a* and a shorter radius portion 132*b*. The longer radius portion 132*a* has an arc of 110 degrees. Two photosensors 134*a*, 134*b* are located adjacent the phase detecting plate 130 and displaced 90 degrees with respect to each other. As shown in FIG. 5B, a region $R_3$ is a region in which the photosensor 134*a* is blocked by the longer radius portion 132*a*, so that an output signal of the photosensor 134*a* indicates an OFF state. A region $R_4$ is a region in which an output signal of the photosensor 134*b* indicates the OFF state. The shortest radius portions 136*a* of the cams 116*a*, 116*b* are located within a region $R_D$. Each output signal of the photosensors 134*a*, 134*b* is input to the MPU 126 through a sensor signal processing circuit 138. In this structure, the MPU 126 controls the rotation of the cams 116*a*, 116*b* to be in a direction of arrow C if an output signal of the photosensor 134*a* is ON and an output signal of the photosensor 134*b* is OFF. On the other hand, the MPU 126 controls the rotation of the cams 116*a*, 116*b* to be in a direction of arrow D if the output signals of the photosensors 134*a*, 134*b*** indicate states different from those described above.

Assuming that inaccuracy in the manufacture or assembly of the parts occurs, the output signal of the photosensor **134*a* can be OFF and the photosensor 134*b* can be OFF (causing rotation in the direction of arrow D) because the shortest radius portions 136*a* of the cams 116*a*, 116*b* are located within a region $R_D$, even though the photosensor 134*a* should have an ON output signal and the photosensor 134*b* should have an OFF output signal. In this situation, the cam followers 118*a*, 118*b* are positioned on the shortest portion 136*a* of the cams 116*a*, 116*b* where an end portion 132*c* of the longer radius portion 132*a* of phase detecting plate 130 is located near a position where the photosensor 134*a* is just blocked out. The cam followers 118*a*, 118*b* therefore are stopped by a stepped portion 136*c* between the shortest radius portion 136*a* of the cams 116*a*, 116*b* and the longest radius portion 136*b* thereof, even though the cams 116*a*, 116*b* are rotated in the wrong direction of arrow D. In this situation, where the MPU 126 cannot receive a switching signal of each output signal of the photosensors 134*a*, 134*b* during a predetermined time after rotating the cams 116*a*, 116*b*, the MPU 126 determines that the cams 116*a*, 116*b* are stopped at the step, and the MPU 126 operates the pulse motor 122 to rotate the cams 116*a*, 116*b* in the reverse direction. The MPU 126 operates the pulse motor 122 to rotate the cams 116*a*, 116*b* to move the platen 96 toward a home position $H_P$, as shown in FIG. 5B in accordance with detecting the switching position of the photosensors 134*a*, 134*b***.

If the cams **116*a*, 116*b* are rotated in the wrong direction of arrow D, and an output signal of the photosensor 134*a* immediately changes to ON from OFF, the MPU 126 determines that the cam followers 118*a*, 118*b* are positioned on the shortest portion 136*a* at the cams 116*a*, 116*b*, and therefore the MPU 126 operates the pulse motor 122 to rotate the cams 116***a*, 116*b* in the direction of arrow C. Then, the MPU 136 operates the motor 122 as well, as explained above.

On the other hand, if the photosensor 134*a* is ON and the photosensor 134*b* is OFF (due to manufacture or assembly inaccuracies), while the cams 116*a*, 116*b* are rotated in the direction of arrow C, even through the photosensor 134*a* should have an OFF output and the cams 116*a*, 116*b* should rotate in the direction of arrow D, the operation of the cam mechanism is almost the same as explained above. That is, after rotation in the wrong direction of arrow C, if the output signal of the photosensor 134*a* changes to OFF from ON, MPU 126 determines that the cam followers 118*a*, 118*b* are positioned on the shortest radius portion 136*a* of the cams 116*a*, 116*b*. The MPU 126 then operates the pulse motor 122 to rotate the cams 116*a*, 116*b* in the reverse direction, and the cam followers 118*a*, 118*b* are positioned at the home position as well, as explained above. Therefore, the cams 116*a*, 116*b* and the cam followers 118*a*, 118*b* will not be damaged.

Furthermore, where an end portion 132*d* of the longer radius portion 132*a* is located near a position where the photosensor 134*b* is just blocked out, the cam followers 118*a*, 118*b* are positioned on the longest radius portion 136*b* of the cams 116*a*, 116*b*. Assuming that the output signal of the photosensor 134*a* is OFF, and the output signal of the photosensor 134*b* is OFF (even though the photosensor 134*b* should be ON), the direction of rotation of the cams 116*a*, 116*b* is the same as when the photosensor 134*a* has an OFF output and the photosensor 134*b* has an ON output. Hence, the cam followers 118*a*, 1118*b* only move from the longest radius portion 136*b* of the cams 116*a*, 116*b* to the shortest portion 136*c* of the cams 116*a*, 116*b*. After rotation in the direction of arrow D, an output signal of the photosensor 134*b* changes to OFF from ON. Therefore, the MPU 126 determines that the cam followers 118*a*, 118*b* are positioned on the longest radius portion 136*b* at the cams 116*a*, 116*b*, and keeps moving the cams 116*a*, 116*b* in the same direction of arrow D providing a driving pulse to the pulse motor 122. When the MPU 126 determines that the cam followers 118*a*, 118*b* have reached the home position by counting the driving pulses after the MPU 126 detects that the output signal of photosensor 134*b* changes to OFF from ON, the MPU 126 stops driving the pulse motor 122. The cam followers 118*a*, 118*b*, therefore, do not fall down from the longest radius portion 136*b* to the shortest radius portion 136*a*.

If the output signal of the photosensor 134*a* is OFF and the output signal of the photosensor 134*b* is ON (even though the photosensor 134*b* should have an OFF output), the operation of the cam mechanism 97 is almost the same as explained above. That is, where the cams 116*a*, 116*b* are rotated in the direction of arrow D, because the cam followers 118*a*, 118*b* are positioned on the longest radius portion 136*b* of the cams 116*a*, 116*b*, the cam followers 118*a*, 118*b* move from the longest radius portion 136*b* of the cams 116*a*, 116*b* to the stepped portion 136*c* of the cams 116*a*, 116*b*. When the end portion 132*d* of the longer radius portion 132 reaches a position at the photosensor 134*a*, an output signal of the photosensor 134*a* becomes ON. Therefore, the MPU 126 determines that the cam followers 118*a*, 118*b* are in a position where the photosensor 134*b* has an ON output signal and an output signal of the photosensor 134*a* changes to ON from OFF. The MPU 126 then continues moving cams 116*a*, 116*b* in the direction of arrow D and begins to count the driving pulses which are provided to the pulse motor 122 from the MPU 126. The count value becomes a predetermined value when the cam followers 118*a*, 118*b* reach the home position, and the MPU 126 stops providing the driving pulses to the pulse motor 122. Therefore, the cam followers 118*a*, 118*b* are positioned at the home position without the cams 116*a*, 116*b* and cam followers 118*a*, 118*b* being damaged.

The platen 96 has a support portion 139 where a printing line to be printed out on the bank book 80 is placed. The support portion 139 has a width wider than the bank book 80 as shown in FIG. 6. The platen 96 also has a recessed portion 140 at a center portion along the elongated direction of the platen 96 for locating a gap adjusting mechanism 141.

The gap adjusting mechanism 141 includes a shift mechanism 142 which shifts a gap setting member 144, and a detecting mechanism 146 which detects a position of the gap setting member 144, as shown in FIG. 3 and FIG. 7. The gap setting member 144 is secured to a lever 148 by glue, spot welding, or screw, etc. The gap setting member 144 is fixed to an L-shaped member 150. The L-shaped member 150 has an elongated hole 152, and the L-shaped member 150 is fixed to the gap setting member 144 by a screw 154 through the elongated hole 152. As a result, the position of the L-shaped member 150 is adjustable along a longitudinal direction of the gap setting member 144. The gap setting member 144 also has a roller 156 at an end portion, which is provided to pinch the bank book 80 between the roller 156 and the head mask 102 on the carriage 98.

The lever 148 is rotatably connected to the platen 96 by a supporting rod 158. One end of a spring 160 is hooked on lever 148 and the other end of the spring 160 is fixed to the frame of the printing unit (not shown), so that the lever 148 is biased in the direction of arrow C by the spring 160. An actuator 162 of a solenoid or plunger magnet 164 is connected to the lever 148, and the lever 148 is thereby rotatable about the supporting rod 158 in accordance with magnetization or demagnetization of the plunger magnet 164 under the control of the MPU 126 through a driving unit 166. The plunger magnet 164 is also positioned on the frame of the printing unit (not shown).

A position of the gap setting member 144 is detected by detection of the position of the L-shaped member 150. The position of the L-shaped member 150 is detected by the detecting mechanism 146. The detecting mechanism 146 comprises a plate 168 having a slit 170, a light source 172 such as a lamp, and a light sensing device 174. The plate 168 is fixed to the platen 96, so that the plate is movable with the platen 96. The light sensing device 174 detects light from the light source 172 through the slit 170. A light path formed by light source 172, the slit 170, and the light sensing device 174 is located to be blocked by a lower portion 176 of the L-shaped member 150. An output signal of the light sensing device 174 is input to the MPU 126 through a sensor signal processing circuit 138. In addition, the L-shaped member 150 may have a slit opposite the slit 170, so that when the light from the light source 172 is detected by the sensing device 174 through both slits, it may be determined that the position of the gap setting member 144 is detected.

Figure 8A:
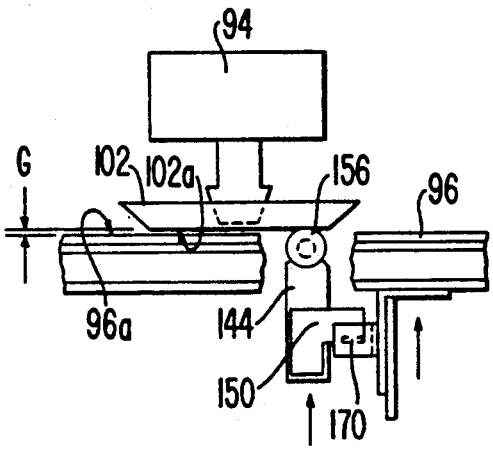
FIGS. 8A and 8B are partial schematic views of primary parts of the printing apparatus in accordance with the present invention, showing a method for adjusting the gap between the surface of the head mask and the surface of the platen during manufacture or maintenance.
Figure 8B:
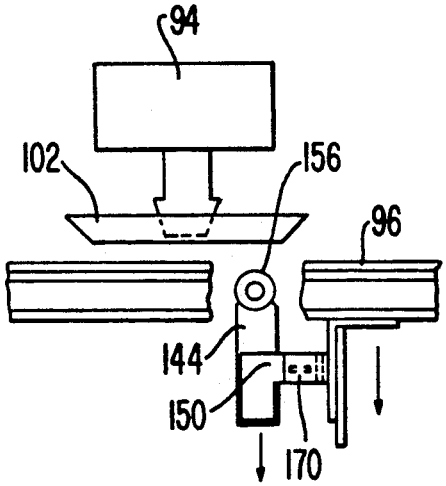
Figure 9A:
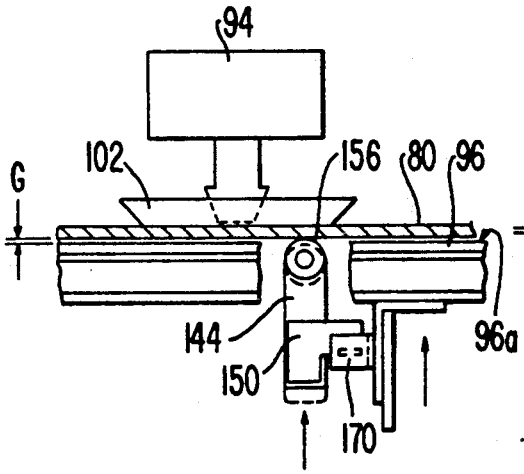
FIGS. 9A and 9B are partial schematic views of primary parts of the printing apparatus in accordance with the present invention, showing a method for adjusting the gap between the surface of the head mask and surface of the bank book during a printing operation.
Figure 9B:
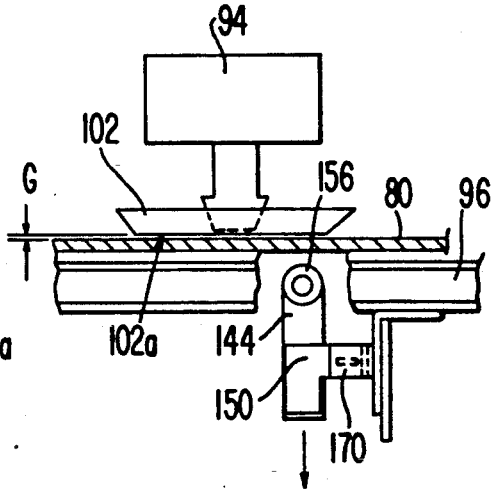

The operation of the structure of FIGS. 3–7 will be explained below with reference to FIGS. 2–7 and FIGS. 8A, 8B, 9A, 9B and 10. FIGS. 8A and 8B are partial schematic views of primary parts of the printing apparatus in accordance with the present invention, showing a method for adjusting the gap between the surface of the head mask 102 and the surface of the platen 96 during manufacturing assembly or maintenance. FIGS. 9A and 9B are partial schematic views of primary parts of the printing apparatus in accordance with the present invention, showing a method for adjusting the gap between the surface of the head mask 102 and the surface of the bank book 80 during a printing operation. FIG. 1 0 is a time chart for explaining the operation of the microprocessor unit 126.

Referring to FIGS. 8A and 8B, first, the cams 116*a*, 116*b* are set at the home position because the position of the cams 116*a*, 116*b* is random initially. In order to set the cams 116*a*, 116*b* to the home position, the MPU 126 checks the output signal of the photosensors 134*a*, 134*b*. The MPU 126 then operates to rotate the cams 116*a*, 116*b* in a direction based on the output signals of the photosensors 134*a*, 134*b*, and positions the cams 116*a*, 116*b* at the home position $H_P$ based on detection of the switching position of the photosensors 134*a*, 134*b*. In this condition, a gap between the surface 96*a* of the platen 96 and the surface 102*a* of the head mask 102 is much wider than the predetermined print gap.

Next, the lever 148 is rotated about the supporting rod 158 by energization of the plunger magnet 164, so that the roller 156 of the gap setting member 144 contacts the surface 102*a* of head mask 102 as shown in FIG. 8A. Then, a gap gage having thickness corresponding to the predetermined print gap (not shown) is interposed into the gap between the surfaces 102*a* and 96*a*. The platen 96 is then moved toward the head mask 102 to pinch the gap gage between the platen 96 and the head mask 102 by rotation of the pulse motor 122. After the gap gage has been pinched between the platen 96 and the head mask 102, the rotation of the pulse motor 122 is stopped. In this situation, the L-shaped member 150 is positioned at a position where the lower portion 176 of the L-shaped member 150 just crosses the light path formed by the light source 172, the slit 170, and the light sensing device 174, by manually sliding the L-shaped member 150 along the longitudinal hole 152. The L-shaped member 150 is then fixed to the gap setting member 144 by tightening the screw 154.

After adjusting the position of the L-shaped member 150, the pulse motor 122 is rotated in the reverse direction and the plunger magnet 164 is de-energized, so that the platen 96 and the roller 156 of the gap setting member 148 are moved toward the home position. In this situation, the L-shaped member 150 is stopped at a position to block the light path of the detecting mechanism 146. Finally, the gap gage is removed from between the platen 96 and the head mask 102, and gap adjusting is completed as shown in FIG. 8B.

A gap adjusting method during the printing operation will be explained with reference to FIGS. 9A, 9B and 1 0. First, the cams 116*a*, 116*b* are set at the home position under control of the MPU 126 in the same manner as the gap adjusting method explained above with respect to FIGS. 8A and 8B. Then, as shown at time T1 in FIG. 10A, the MPU 126 drives a motor (not shown) to rotate the feed rollers 82, 90, and thereby feed the bank book 80 to a position between the head mask 102 and the platen 96. After the bank book 80 is set, the MPU 126 activates the plunger magnet 164 through the driving circuit 166, and the plunger magnet 164 is energized at time T2 to rotate the lever 148 about the supporting rod 158 as shown in FIG. 108. As a result, the bank book 80 is pinched between the surface 102*a* of the head mask 102 and the roller 156 of the gap setting member 144 as shown in FIG. 9A. In this situation, the light path of the detecting mechanism 146 is not blocked by the L-shaped member 150 and therefore the light sensing device 174 detects the light from the light source 172 through the slit 170.

When the light sensing device 174 detects the light from the light source 172 at time T3 as shown in FIG. 10C, the MPU 126 activates the pulse motor 122 at time T4 to rotate the cams 116*a*, 116*b* as shown in FIG. 10D, and the platen 96 is moved toward the mask 102. Since the plate 168 moves with the platen 96, when the light path formed by the light source 172, the slit 170, and the light sensing device 174 is blocked by a lower portion 176 of the L-shaped member 150 at time T5 as shown in FIG. 10C, the light sensing device 174 detects that the platen 96 has reached a position where a gap between the surface of the head mask 102 and the surface of the bank book 80 is at a predetermined value. The output signal from the light sensing device 174 is output to the MPU 126, and the MPU 126 then deactivates the pulse motor 122 at time T6 as shown in FIG. 10D. In this situation, a predetermined print gap G is formed between the lower surface of the bank book 80 and the surface 96*a* of the platen 96 as shown in FIG. 9A.

Finally, the plunger magnet 164 is de-energized at time T7 under control of the MPU 126 as shown in FIG. 10B, and the roller 156 and the gap setting member 144 are moved away from the head mask 102. The predetermined print gap G is then formed between the upper surface of the bank book 80 and the surface 102*a* of the head mask 102, as shown in FIG. 9B. Thus, a gap G between the surface 102*a* of the head mask 102 and the surface of the bank book 80 is set to be a predetermined value independently of the thickness of the bank book 80.

Figure 10:
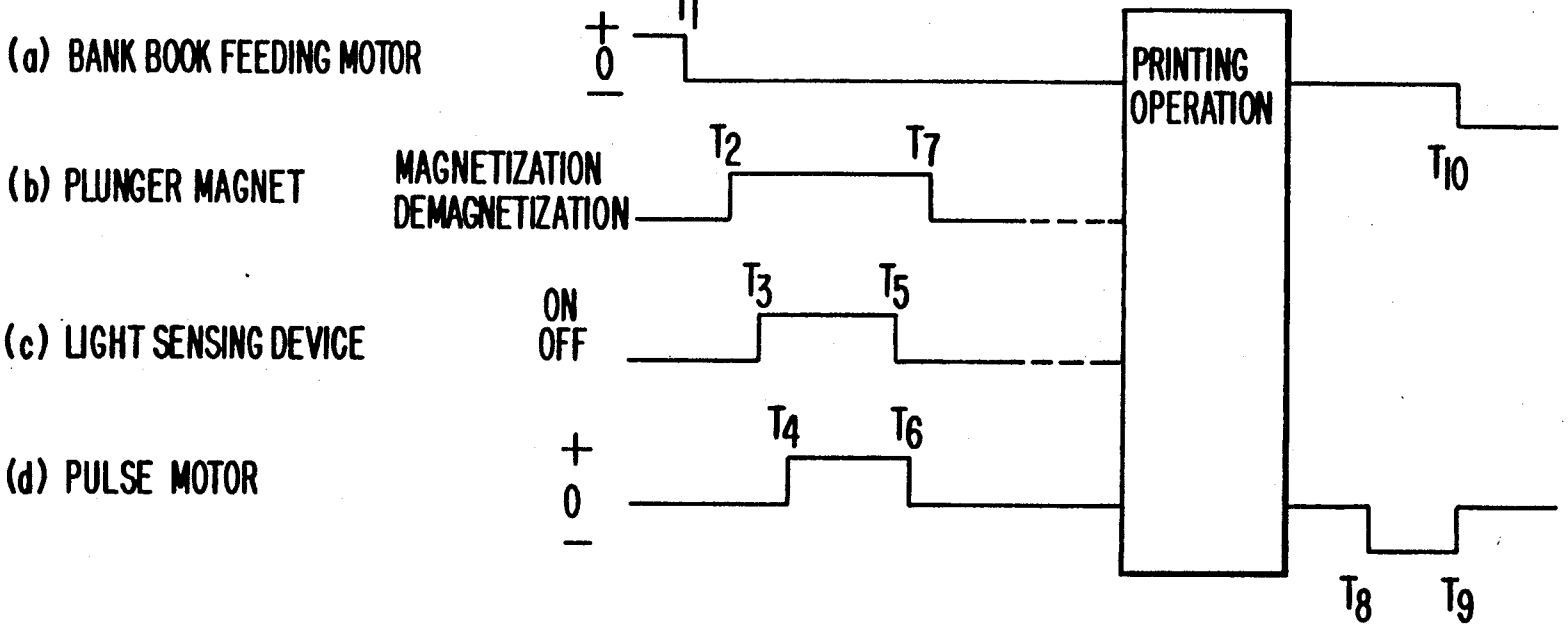
FIG. 10 is a time chart for explaining the operation of the microprocessor unit of FIG. 3.

Next, a printing operation is performed by the printing head 94 (see FIG. 10). After that, the pulse motor 122 is driven by the MPU 126 at time T8 as shown in FIG. 10D, so that the platen 96 is moved toward the home position. Finally, after the platen 96 is positioned at the home position, the pulse motor is deactivated at time T9 as shown in FIG. 10D, and the bank book 80 is moved toward the reading/writing head 88 by the feed rollers 90, 98 at time T10 under control of the MPU 126 as shown in FIG. 10A.

In the above-described embodiment, the printing operation is carried out without defective printing because the surface 102*a* of the head mask 102 does not protrude anywhere, so that the bank book 80 is not hooked or snagged by a sensor during the line feed or carriage scanning.

As an alternative, it is possible to provide the recessed portion of the platen 96 at two positions adjacent both ends of the platen 96 and to provide a gap adjusting mechanism at each of these positions. In this alternate embodiment, a gap between the head mask 102 and bank book 80 may be adjusted according to either of the gap adjusting mechanisms. It is desirable to use the gap adjusting mechanism adjacent the thicker portion of the bank book 80, so that the gap is adjustable when the thickness of the bank book 80 is different on different sides of the bank book.

Figure 11A:
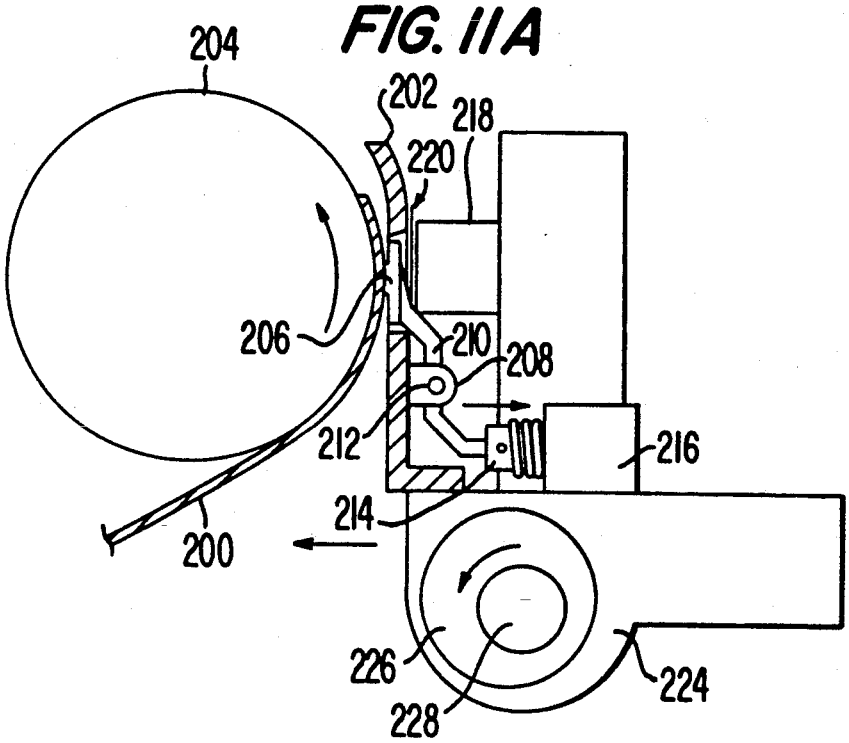
Figure 11B:
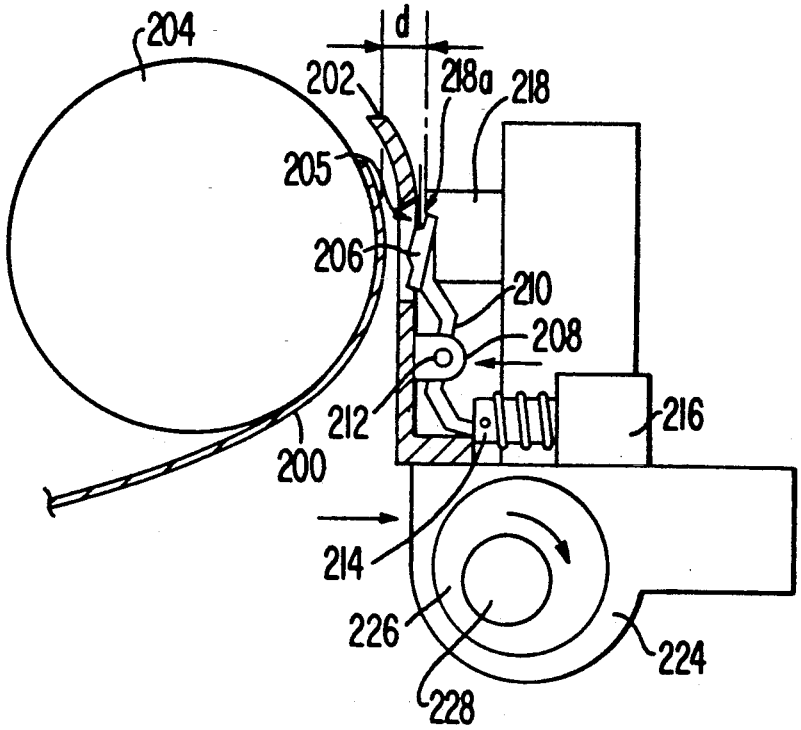
Figure 12:
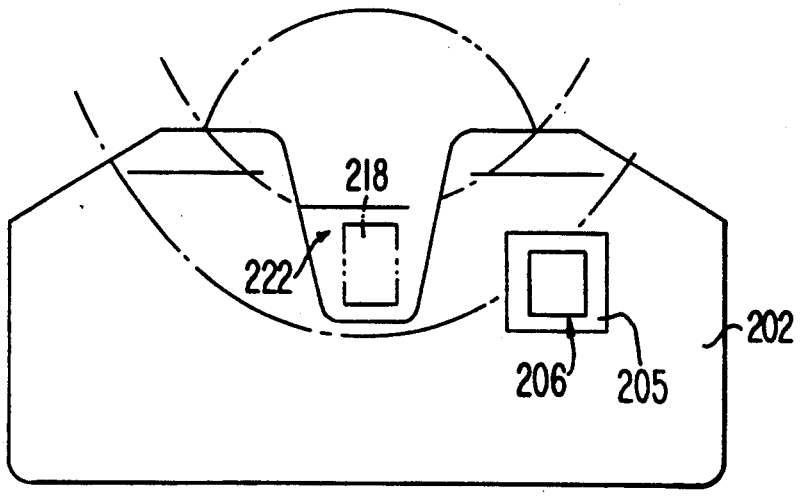
FIG. 12 is a front view of the printing head of the printing apparatus shown in FIGS. 11A and 11B.

FIGS. 11A, 11B are schematic views of another embodiment of a printing apparatus using the present invention. In FIG. 11A, a pressure sensor approaches a recording paper on a platen, and in FIG. 11B a pressure sensor is retracted from a recording paper on a platen. FIG. 12 is a front view of the printing head of the printing apparatus shown in FIGS. 11A and 11B. FIGS. 13A through 13D are diagrams for explaining the structure of the pressure sensor shown in FIGS. 11A, 11B and 12. In each of these figures, recording paper 200 is fed between a paper guiding plate 202 and a cylindrical type platen 204 by a feed roller (not shown). The paper guiding plate 202 has a hole 205 through which a panel keyboard switch 206 which acts as a pressure sensor, is moved toward or away from the platen 204. A supporting member 208 rotatably holds a lever 210 supporting the panel keyboard switch 206 about a pivot pin 212. An end of the lever 210 is connected to an end of an actuator 214 of a plunger magnet 216 to move toward or away from the platen 204.

The paper 200 is imprinted by a printing head 218 which is located opposite the platen 204, with an ink ribbon 220, a print window 222 of the paper guiding plate 202, and the paper 200 therebetween. The printing head 218 is placed on a carriage 224 and is set with a gap between an end portion 218*a* of the printing head 218 and the surface of the platen 204, at a predetermined value d. The paper guiding plate 202, the panel keyboard switch 206, and the plunger magnet 214 are also placed on the carriage 224. Therefore, a gap between the end portion 218*a* of the printing head 218 and the surface of the panel keyboard switch 206 when it is located at an extended position as shown in FIG. 11A, is also set to a predetermined value.

The carriage 224 is provided on a shaft 226 which is located in parallel with the platen 204. The carriage 224 is moved along the shaft 226 by a driving source (not shown). The shaft 226 is provided with an eccentric shaft 228 so that there are two axes of rotation. The eccentric shaft 228 is supported by a frame of the printing apparatus (not shown), so that the carriage 224 is moved toward or away from the platen 204 together with the printing head 218, the paper guiding plate 202, the panel keyboard switch 206, the ink ribbon 220, and the plunger magnet 216, by rotation of the eccentric shaft 228.

Figures 13A, 13B, 13C, 13D:
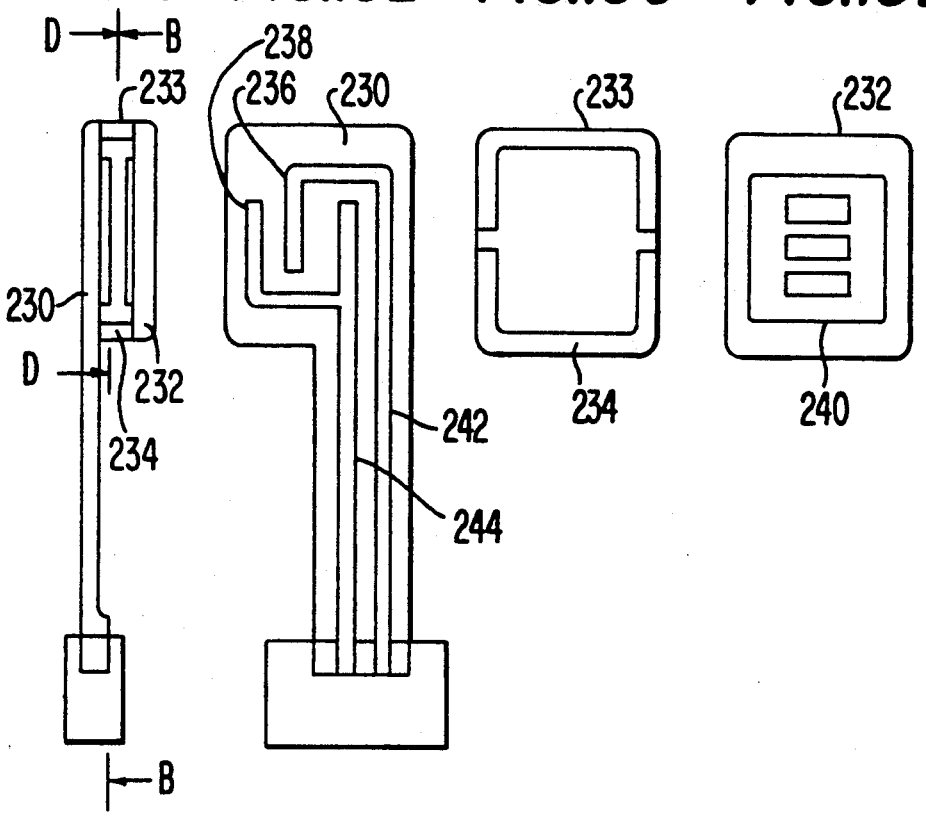
FIG. 13A is a side cross-sectional view of the panel keyboard switch 206.
FIG. 13B is a cross-sectional view taken along the line B—B of FIG. 13A.
FIG. 13C is a plan view of spacers.
FIG. 13D is a cross-sectional view taken along the line D—D of FIG. 13A.
Figure 14:
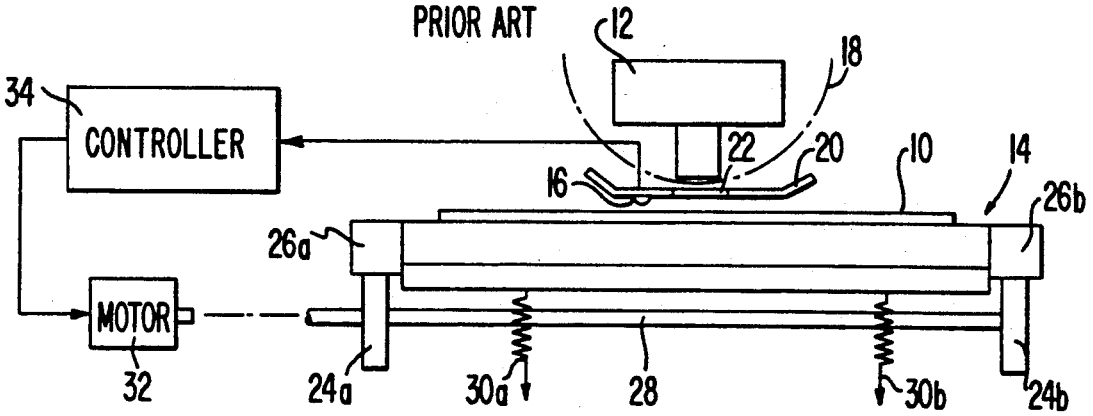
FIG. 14 PRIOR ART
FIG. 14 is a front elevation view of a prior art printing apparatus.
Figure 15:
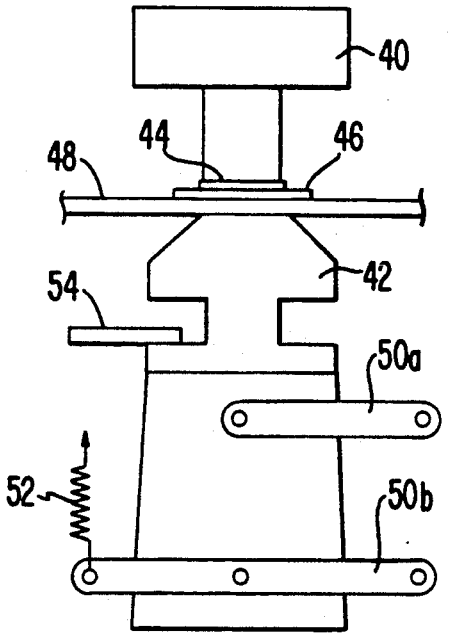
FIG. 15 PRIOR ART
FIG. 15 is a side elevation view of another prior art printing apparatus.

The detailed structure of the panel keyboard switch 206 is shown in FIGS. 13A-13D. FIG. 13A is a side cross-sectional view of the panel keyboard switch 206, FIG. 13B is a cross-sectional view taken along the line B—B of FIG. 13A, FIG. 13C is a plan view of the spacers shown in FIG. 13A, and FIG. 13D is a cross-sectional view taken along the line D—D of FIG. 13A. Referring to FIGS. 13A-13D, the panel keyboard switch 206 comprises two patterned thin film boards 230 and 232 which are made of polyurethane resin. The film boards 230 and 232 are spaced apart by resilient spacers 233 and 234 to form a predetermined gap, for example 0.1 mm to 0.03 mm, between the thin patterned film boards 230 and 232. The board 230 is a base board formed with two conductive patterns 236 and 238, and the board 232 is an upper board formed with a single conductive pattern 240. The material of the upper board 232 has characteristics that the Shore hardness is 70 or more and the coefficient of friction with respect to paper is 0.2 or less for wear prevention. Lead cables 242 and 244 for the two conductive patterns 236 and 238 are connected to a signal processing circuit (not shown). In this structure, when the upper board 232 is pushed against the paper 200, the single conductive pattern 240 contacts the base board 230 to connect the two conductive patterns 236 and 238, and thus connection is detected by the signal processing circuit through the lead cables 242 and 244. The operation of this embodiment will be explained below with reference to FIGS. 11-13. First, in a situation where the carriage 224 is moved to a release position as shown in FIG. 11B, the paper 200 is fed between the platen 204 and the paper guiding member 202. Then, the plunger magnet 216 is energized and the panel keyboard switch 206 is projected to the front side of the paper guiding member 202 through the hole 205. After that, the eccentric shaft 228 is rotated and the carriage 224 is moved to an approach position as shown in FIG. 11A, so that the upper board 232 of the panel keyboard switch 206 contacts the paper 200. After the panel keyboard switch 206 outputs the detection signal, the rotation of the eccentric shaft 228 is stopped, the eccentric shaft 228 is rotated in the reverse direction by an amount equal to the predetermined gap d. Finally, the plunger magnet 216 is de-energized, the panel keyboard switch 206 is released from the surface of the paper and retracted inside the paper guiding plate 202 through the hole 205. After the gap has been adjusted, a printing operation is performed by the printing head 218.

According to this embodiment, the surface of the sensor does not slide during a line feed or print operation, so that the gap between the end portion of the printing head 218 and the surface of the panel keyboard switch 206 is maintained for a long period of time, and the hooking or snagging of the paper, and the oblique feeding of the paper does not occur. Furthermore, even if the paper is single layer paper or multi-layer paper which is capable of duplicate printing, the gap between the surface of the paper and the end portion of the printing head is set to the proper value.

In addition, where a recording medium having a varying thickness along the feed direction of the recording medium, is used as a recording medium in a printing apparatus, a gap between the printing head and the platen is adjusted to be a predetermined gap in accordance with the thickness of the recording medium which is between the printing head and the platen. In this situation, the printing apparatus can adjust the gap during each scanning of the printing head or after line feed under control of the microprocessor unit.

What is claimed is:

1. A printing apparatus comprising:

a carriage having a printing head which prints on a recording medium, the printing head including a contact area;

a platen having a surface disposed opposite the contact area;

first shift means for relatively moving the contact area and said platen toward or away from each other;

detecting means for detecting a thickness of the recording medium adjacent a printing position which is between the contact area and said platen, and for producing an output signal, said detecting means having a contact portion which pinches the recording medium between the contact area and the contact portion;

second shift means for relatively moving said detecting means toward or away from the contact area;

first control means for controlling said first shift means to form a predetermined gap between the contact area and a surface of the recording medium in accordance with the output signal from said detecting means; and second control means for controlling said second shift means to move the contact portion of said detecting means away from the contact area after said first shift means forms the predetermined gap between the contact area and the surface of the recording medium.

2. A printing apparatus as recited in claim 1, wherein said printing head comprises:

a wire dot type print head;

an ink ribbon positioned between said wire dot type print head and said platen; and a head mask positioned between said ink ribbon and said platen, said head mask being the contact area of said printing head, and wherein the contact portion of said detecting means pinches the recording medium between said head mask and the contact portion of said detecting means.

3. A printing apparatus comprising:

a printing head which prints on a recording medium;

a platen disposed opposite said printing head;

first shift means for moving said platen toward or away from said printing head;

detecting means for detecting a thickness of the recording medium which is between said printing head and said platen, said detecting means including:

a gap setting member having a contact portion to press the recording medium against said printing head during an operating mode; and a sensor having a sensing portion and a sensed portion, one of the sensing portion and the sensed portion of said sensor being fixed to said platen and the other of the sensing portion and the sensed portion being fixed to said gap setting member, and the sensing portion outputting a detection signal when the sensing portion senses the sensed portion, said sensor being disposed at a predetermined position where a gap between said printing head and said platen becomes a predetermined value when the detection signal is output from the sensing portion;

second shift means for moving said gap setting member to pinch the recording medium between said printing head and the contact portion and to separate from the recording medium during the operating mode; and control means for controlling said first and second shift means to move said gap setting member toward said printing head until the recording medium is pinched between the contact portion of said gap setting member and said printing head, to move said platen toward said printing head to stop said platen when the detecting signal is output from the sensed portion of said sensor, and to retract said gap setting member until the contact portion is removed from the surface of said platen, during an adjusting mode.

4. A printing apparatus as recited in claim 3, wherein said printing head comprises:

a wire dot type print head;

an ink ribbon positioned between said wire dot type print head and said platen; and a head mask positioned between said ink ribbon and said platen, and wherein the contact portion of said gap setting member contacts said head mask in the adjusting mode.

5. A printing apparatus as recited in claim 3, wherein said first shift means comprises:

cam followers fixed to said platen;

cams engaging said cam followers; and a drive source for rotating said cams.

6. A printing apparatus as recited in claim 3, wherein said sensor is a photosensor which comprises a shield member and a photosensitive member.

7. A printing apparatus as recited in claim 6, wherein the shield member is fixed to the gap setting member and the photosensitive member is fixed to said platen.

8. A printing apparatus comprising:

a carriage having a printing head which prints on a recording medium, the printing head including a contact area;

a platen having a surface disposed opposite the contact area;

first shift means for relatively moving the contact area and said platen toward or away from each other to form a predetermined gap between the contact area and a surface of the recording medium on the surface of said platen;

detecting means for detecting a thickness of the recording medium adjacent a printing position which is between the contact area and said platen, and for producing an output signal, said detecting means having a contact portion which contacts the surface of the recording medium between the contact area and said platen;

second shift means for moving the contact portion of said detecting means toward or away from the contact area; and control means, operatively connected to said detecting means, for controlling said second shift means to move the contact portion of said detecting means away from the surface of the recording medium after it is determined that the predetermined gap between the contact area and the surface of the recording medium has been formed in accordance with the output signal from said detecting means.

9. A printing apparatus as recited in claim 8, wherein said control means comprises means for controlling said first shift means to move said contact area and said platen relatively toward or away from each other.

10. A printing apparatus as recited in claim 9, wherein said control means controls said first and second shift means to move said contact area and said platen toward each other such that the contact portion is positioned toward the surface of the recording medium on the surface of said platen.

11. A printing apparatus as recited in claim 10, wherein said detecting means comprises a contact type sensor.

12. A printing apparatus as recited in claim 9, wherein said control means controls said first and second shift means to move the contact portion toward the contact area to move the contact area and said platen toward each other after the contact portion pinches the recording medium against the contact area, and to move the contact portion of said detecting means away from the contact area after it is determined that the predetermined gap between the contact area and the surface of the recording medium has been formed in accordance with the output signal from said detecting means.

13. A printing apparatus as claimed in claim 12, wherein said detecting means comprises a sensing portion and a sensed portion, one of the sensing portion and the sensed portion being fixed to said platen and the other being fixed to the contact portion, and wherein the sensing portion outputs the output signal when the sensing portion senses the sensed portion, the sensing portion and the sensed portion being disposed at a predetermined position where a gap between the surface of said platen and the surface of the recording medium becomes the predetermined value when the sensing portion outputs the output signal.

* * * * *

UNITED STATES PATENT AND TRADEMARK OFFICE

CERTIFICATE OF CORRECTION

PATENT NO. : 5,316,395

DATED : MAY 31, 1994

INVENTOR(S) : Masayuki IMAI

It is certified that error appears in the above-indentified patent and that said Letters Patent is hereby corrected as shown below:

Col. 13, line 56, "head" should be --head,--.

Col. 14, line 61, "area" should be --area,--

Signed and Sealed this

Twenty-fourth Day of January, 1995

*Attest:*

Bruce Lehman

BRUCE LEHMAN

*Attesting Officer*

*Commissioner of Patents and Trademarks*